United States Patent [19]

Catenaccio

[11] 4,094,351

[45] June 13, 1978

[54] LAUNDRY BAG

[76] Inventor: Frank Catenaccio, 222 Cayler St., Brooklyn, N.Y. 11222

[21] Appl. No.: 729,724

[22] Filed: Oct. 5, 1976

[51] Int. Cl.[2] ..... A45C 11/00

[52] U.S. Cl. ..... 150/7; 150/3; 150/1

[58] Field of Search ..... 150/1, 3, 7; 224/5 Q, 224/5 MA, 8 R, 26 A, 26 D

[56] References Cited

U.S. PATENT DOCUMENTS

| | | | |
|---|---|---|---|
| 3,521,689 | 7/1970 | Woods | 150/7 |
| 3,717,188 | 2/1973 | Green | 150/1 |
| 3,831,650 | 8/1974 | Consorti | 150/7 |
| 3,888,486 | 6/1975 | Sutter | 150/7 |
| 3,943,988 | 3/1976 | Consorti | 150/7 |

*Primary Examiner*—Ro E. Hart
*Attorney, Agent, or Firm*—Richard L. Miller

[57] ABSTRACT

A bag is disclosed within which laundry can be carried by a person between the person's home and a laundry washing machine; the bag being of canvas and attached to a should strap so to be slung over a shoulder, a top flap of the bag having rope loops attached thereupon in the shape of a ship steering wheel, the loops being engagable with knots around the bag mouth, compartments inside the bag for white or plain laundry items, air vent holes around the bag side, several short feet on an underside of the bag for supporting it off a possibly wet floor of a laundry room, and an end of the shoulder strap having a utility bag secured thereto for carrying soap powder items and magazines.

3 Claims, 4 Drawing Figures

Fig. 1
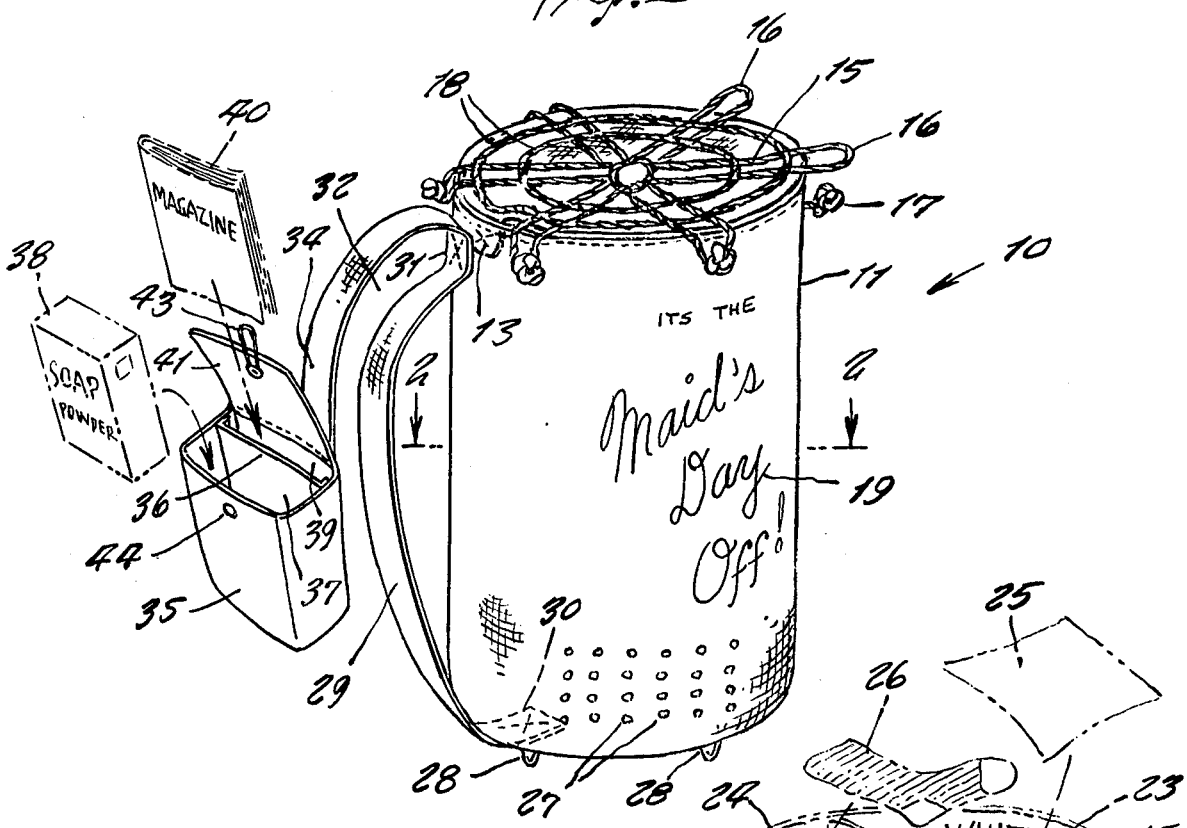
Fig. 3
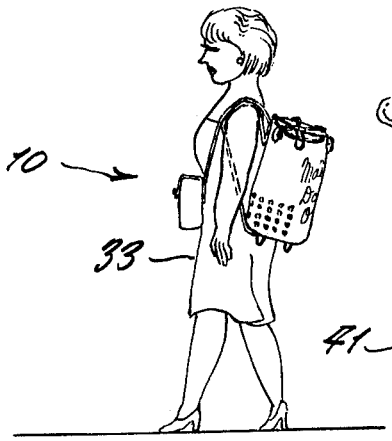
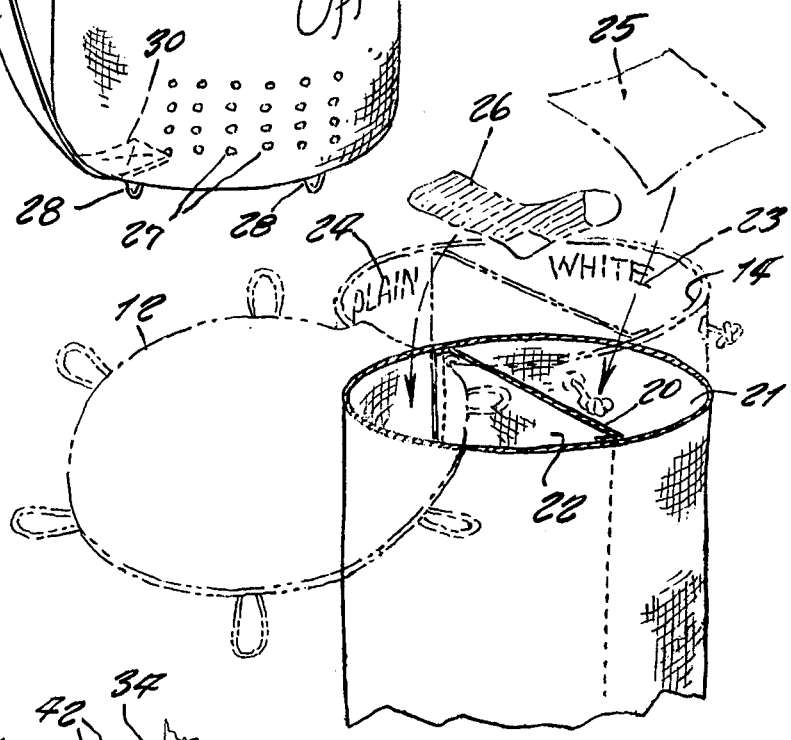
Fig. 2
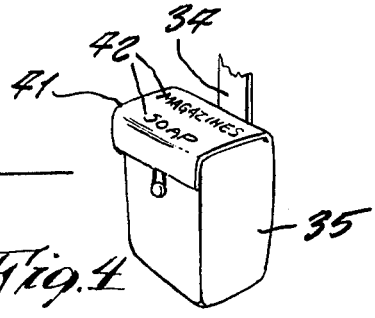
Fig. 4

LAUNDRY BAG

This invention relates generally to laundry bags such as within soiled laundry can be placed for being laundered.

A principal object of the present invention is to provide a laundry bag that is designed for being conveniently and without strain carried on a person's back so to eliminate need of hunching over while walking and thus not hurt a person's posture; the bag being designed to additionally be attractive and smart in appearance.

Another object is to provide a Bag-O-Wash laundry bag whose weight is supported from a shoulder, and which is balanced by a utility bag resting against a front of a person; the utility bag serving to transport washing powder, bleach or other laundering additives, and also carrying magazines or other material to occupy a person while the laundry is being washed and dried in the washing and drying machines.

Still another object is to provide a Bag-O-Wash laundry bag which is divided into compartments for separating white from plain laundering articles so to eliminate need of clothes-sorting at the machine.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a perspective view of the invention.

FIG. 2 is a fragmentary perspective view shown with bag lid opened and illustrating the bag compartments.

FIG. 3 is a perspective view of the invention being carried by a person.

FIG. 4 is a perspective view of the soap and magazine utility bag portion of the invention, illustrated in a closed position.

Referring now to the drawing in greater detail, the reference numeral 10 represents a Bag-O-Wash laundry bag according to the present invention wherein there is a canvas bag 11 shaped cylindrical like a sailor's duffle bag having an open upper end closable by a circular canvas lid 12 attached to the bag by a stitching 13 that extends approximately one quarter the circumferential length of the bag mouth 14. The upper side of the lid has several looped ropes 15 secured thereto and extending radially so the loop 16 at the lid edge can be hooked to rope knits 17 secured around the bag upper end, so to hold the lid to close the bag mouth. Other additional ropes 18 are attached circularly on the lid so that together with the looped ropes they form a nautical design of a ship wheel.

Upon an outer side of the bag, any witty slogan can be imprinted or shown at 19 so to give a modern effect, and add to the attractiveness of the bag.

Within the interior of the bag, a partition 20 of canvas is stitched so to form two compartments 21 and 22, each of which is identified by words 23 and 24 respectively imprinted on the inner side of the bag and located near the bag mouth so to be easily readable by a person; one of the words 23 indicating the compartment 21 is to be used for white laundry articles 25, while the word 24 indicates the compartment 21 is to be used for plain laundry articles 26 such as colored socks, color-dyed items and the like.

Grommeted, perforated openings 27 through the side of the bag serve to ventilate the bag interior so to prevent development of unpleasant odors therewithin.

The bottom of the bag may possibly be fitted with a stiffner (not shown); the stiffner having several short downwardly extending feet 28 for supporting the bag bottom off a floor that may possibly be wet with water puddles such as sometimes occur in a laundry room.

A shoulder strap 29 is secured at one end 30 to a bottom of the bag while an intermediate portion 31 thereof is attached near the bag upper end so to form a loop 32 for fitting around a shoulder of a person 33. An opposite end 34 of the strap is secured to a utility bag 35 having a partition 36 so to form a compartment 37 for holding a box of washing powder 38 or other laundering additives such as bleach, and a compartment 39 for holding magazines 40 or other busy work such as knitting materials in order to occupy a person while a laundry is being washed and dried. A lid 41 of the bag 35 can be imprinted with words as shown at 42 so to indicate the purpose thereof. A rubber loop 43 and button 44 secures the lid 40 in closed position.

As shown in FIG. 3, the bag 11 rests against a person's back while the bag 35 is at a front so to aid balancing the load and allow a person to walk erect instead of bent over.

Thus a Bag-O-Wash is provided.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A laundry bag, comprising in combination, a canvas bag for containing laundry articles, a utility bag for containing a box of washing powder and magazines or related objects, and a shoulder strap secured to said canvas bag and utility bag for resting across a person's shoulder with said canvas bag at said person's back and said utility bag at a front, said canvas bag has a mouth at an upper end closable by a canvas lid hingedly stitched to said canvas bag, said lid having several looped ropes attached thereupon and extending radially with loops at an edge of said lid, said loops being engagable with rope knits around said bag upper end, said looped ropes together with other circular ropes attached on said lid having the nautical shape of a ship wheel.

2. The combination as set forth in claim 1 wherein said canvas bag has a central partition dividing an interior thereof into compartments identified for white and plain laundry articles, a side of said bag having perforated vent openings, and a bottom of said bag having downward feet.

3. The combination as set forth in claim 1 wherein said utility bag is divided by a partition to form separate compartments for said washing powder box and said magazines, and a flap lid of said utility bag being imprinted with words "soap" and "magazines."

* * * * *